US005529603A

United States Patent [19]

Yamashita et al.

[11] Patent Number: 5,529,603

[45] Date of Patent: Jun. 25, 1996

[54] ALLOY POWDERS FOR BOND MAGNET AND BOND MAGNET

[75] Inventors: Michio Yamashita, Kyoto; Hirokazu Kitayama, Osaka; Yoshihiko Nishino, Suita; Toshihiro Hurukawa, Takatsuki, all of Japan

[73] Assignee: Sumitomo Special Metals Company Limited, Osaka, Japan

[21] Appl. No.: 196,186

[22] PCT Filed: Jun. 25, 1993

[86] PCT No.: PCT/JP93/00864

§ 371 Date: Jun. 17, 1994

§ 102(e) Date: Jun. 17, 1994

[87] PCT Pub. No.: WO94/00259

PCT Pub. Date: Jan. 6, 1994

[30] Foreign Application Priority Data

Jun. 26, 1992 [JP] Japan ..... 4-193055

[51] Int. Cl.[6] ..... B22F 9/00

[52] U.S. Cl. ..... 75/246; 75/228; 75/245; 75/252; 75/253; 75/255

[58] Field of Search ..... 252/62.53, 62.55, 252/62.58, 62.59; 75/228, 245, 246, 252, 253, 255

[56] References Cited

U.S. PATENT DOCUMENTS

| | | | |
|---|---|---|---|
| 5,015,307 | 5/1991 | Shimotomai et al. | 148/302 |
| 5,213,631 | 5/1993 | Akioka et al. | 148/302 |
| 5,227,723 | 7/1993 | Hirai et al. | 335/212 |
| 5,240,627 | 8/1993 | Mohri et al. | 252/62.54 |
| 5,256,326 | 10/1993 | Kawato et al. | 252/62.54 |
| 5,300,156 | 4/1994 | Mohri et al. | 148/104 |

FOREIGN PATENT DOCUMENTS

| | | | |
|---|---|---|---|
| 58-64358 | 7/1983 | Japan | C22G 38/52 |

*Primary Examiner*—Donald P. Walsh
*Assistant Examiner*—John N. Greaves
*Attorney, Agent, or Firm*—Watson Cole Stevens Davis

[57] ABSTRACT

It is an object of the present invention to provide a fire resistance bond magnet having superior temperature properties and most suitable for convergence use in picture tubes for display and high precision television, and alloy powders for bond magnet, without containing Co which is restricted in resources. The flame retardancy bond magnet having superior temperature properties and most suitable for convergence use in picture tubes for display and high precision television can be provided at low cost without containing Co, by using the alloy powders for bond magnet consisting of Al-Ni-Cu-(Ti, Nb)-Fe without Co, and having an isotropy and mean particle sizes of 10 μm to 200 μm, and kneading, molding and curing the 20 wt % to 80 wt % alloy powders together with a chlorine flame retardant, a flame retardant assistant such as antimony trioxide and zinc boric acid and a binder.

13 Claims, No Drawings

ALLOY POWDERS FOR BOND MAGNET AND BOND MAGNET

TECHNICAL FIELD

The present invention relates to alloy powders for a bond magnet which can be molded into various shapes, and and particularly to alloy powders for a bond magnetic having superior temperature characteristics, bond magnet.

BACKGROUND ART

A bond magnet is manufactured by molding a compound prepared by mixing and kneading magnetic alloy powders of desired compositions with resins, a flame retardant and so on, into various shapes by means of injection molding, compression molding and extrusion molding, so that thin and complicated shapes can be easily manufactured and uniform characteristics obtained without cracks and chips. Such magnets are widely used in magnetic circuits of electronic components, in audio equipment, OA equipment and the like.

Conventionally, a ferrite magnet powder and a rare earth magnet powder are generally used as the magnet powders for the bond magnet, and alnico magnet alloy powder is also used in a focusing magnet for focusing electronic beams and in color adjusting convergence in picture tube in television or display Braun tubes, because of its (1) superative temperature characteristics, (2) a higher saturated magnetic flux density than the ferrite magnet powder, and superior oxidation resistance and weatherproof as compared with the rare earth magnet powder. Such powders are furthermore low in cost.

As the alnico magnet, alnico 8 having a coercive force of 1000 Oe or more and alnico 5 having a coercive force of about 500 to 700 Oe are well known, both having a low temperature change of magnet characteristics of 0.05%/°C. or less.

The inventor has previously proposed bond magnets of alnico 5 and alnico 8 (Japanese Patent Application Laid Open No. Hei 4-239103), and an alnico bond magnet is also disclosed in the Japanese Patent Application Laid Open Nos. Hei 3-239306 and Hei 3-259502.

However, since the Alnico type magnet alloys consisting of alnico 5 and alnico 8 all contain a large amount of Co, i.e., about 25% to 40%, there was the possibility of high product cost and uncertainty in supply of raw materials.

Also, though fire resistance is required a bond magnet used in domestic appliances and in OA equipment, some products using a bromic flame retardant have the possibility of producing dioxine having a toxicity at the time of combustion, thus the regulation of its use is being studied in U.S.A. and Europe.

It is an object of the present invention to provide alloy powders for bond magnet which do not contain cobalt, which is scarce in resources, and is composed mainly of Fe-Ni-Al-Cu having good temperature characteristics, and to provide a bond magnet containing a flame retardant which is safe to dispose and at the time of combustion such as a fire.

SUMMARY OF THE INVENTION

In the present invention, as a result of various studies made on alloy compositions which do not contain precious Co such as alnico 5 and alnico 8 as a bond magnet used, for example, in convergence which is used, for correcting beams of picture tubes in the color televisions and display Braun tubes, while making a good use of low temperature coefficient characteristics of the magnet characteristics, we found that it is possible to use as same as the costly Co alnico types, when pulverized into desired particles at the specific compositions substantially containing no Co, and as a result of various studies on blending for fire resistance as the bond magnet, by containing a necessary amount of specific flame retardants, the bond magnet having the fire resistance qualified by a combustion test of UL-94 Vo, and having little possibility of exhausting toxic substances such as dioxine can be obtained.

The alloy powders for bond magnet of the present invention is characterized by containing 10 wt % to 16 wt % Al, 23 wt % to 33 wt % Ni, 2 wt % to 8 wt % Cu, less than 5 wt % of one or two kind of Ti, Nb, and balance Fe and unavoidable impurities, and by having an isotropy and mean particle sizes of 10 μm to 200 μm.

The present invention also proposes, in the above-mentioned configuration, alloy powders for bond magnet having the coercive force (iHc) above 550 Oe, and the alloy powders for bond magnet which can be pulverized mechanically easily and contains 0.5 wt % to 5.0 wt % of one or two kinds of Ti and Nb.

The present invention is directed to the bond magnet which is flame retardant and characterized by, containing 10 wt % to 16 wt % Al, 23 wt % to 33 wt % Ni, 2 wt % to 8 wt % Cu, 5 wt % or less one or two kinds of Ti and Nb, and Fe and unavoidable impurities, and by having an isotropy, alloy powders of 10 μm to 200μ mean particle sizes and a binder.

The present invention also proposes, in the above-mentioned configuration of the bond magnet,

- a bond magnet containing 20 wt % to 98 wt % alloy powders,
- a bond magnet containing 20 wt % to 80 wt % alloy powders,
- a bond magnet which contains 5 wt % to 50 wt % flame retardant, having a fire resistance and is most suitable for convergence use,
  - a bond magnet containing 2 to 45% silicate of components other than the alloy powders as an inorganic filter, and
  - a bond magnet having 150 G to 1300 G Br, 150 Oe to 500 Oe iHc and 0.01 MGOe to 0.15 MGOe(BH) max, and 0.07 %/°C. or less temperature coefficient of magnetic property.

In the present invention, by pulverizing an isotropic permanent magnet obtained by melting the alloy having the above-mentioned compositions for predetermined heat treatment into powder having the mean particle sizes of 10 μm to 200 μm, the Fe-Ni-Al-Cu magnet powders most suitable as the bond magnet and having a good magnetic property and temperature characteristics is obtained.

Though a so-called alnico magnet such as alnico 5 and alnico 8 contains, 7 to 10 wt % Al, 12 to 18 wt % Ni, 5 to 40 wt % Co and 1 to 8 wt % Cu as the essential compositions, and is further added with several % Ti, Nb, Si and the like, according to the present invention, the superior magnetic property is obtained by increasing the contents of Al and Ni even though Co, which is scarce in resources, is not contained, and by containing a predetermined amount of Cu, Ti and Nb to improve the heat treatment and grindability, the alloy powders for bond magnet and the bond magnet using said powders which are technically valuable can be realized.

BEST MODE FOR CARRYING OUT THE INVENTION

In the following, restricted reasons of compositions of alloy powders for bond magnet and the bond magnet according to the present invention are described.

Al is an essential composition to obtain superior magnet characteristics without containing Co, and it is preferably contained by 10 wt % to 16 wt %, because that a coercive force will drop when below 10 wt %, and both the coercive force and a residual magnetic flux density are lowered when above 16 wt %.

Ni is an essential composition to obtain the superior magnet characteristics without containing Co, and it is preferably contained by 23 wt % to 33 wt %, because that the coercive force will drop when below 23 wt %, and the residual magnetic flux density is lowered when above 33 wt %.

Cu is preferably contained by 2 wt % to 8 wt %, because that the coercive force as well as the residual magnetic flux density are lowered within the range of heat treatment conditions to be described later, when below 2 wt % and above 8 wt %.

Though Ti and Nb are added to improve the residual magnetic flux density and grindability, when more than 5 wt %, each of Ti and Nb are added, or when adding the two above 5 wt % in total, the residual magnetic flux density is lowered, but since it is difficult to grind at 0.1 wt % or less, it is preferably 0.1 wt % to 5 wt %, and more preferably, 0.5 wt % or more to grind efficiently.

Fe is a nucleus of Fe-Ni-Al-Cu and occupies the remainder of Ni, Al and Cu.

Besides the above-mentioned essential compositions, Si is effective in improving, particularly, a cooling speed from fusing temperature in the heat treatment and a castability thus it may be added by 0.01 wt % to 0.5 wt %.

Co is, basically, not an essential component of the present invention. However, sometimes it is mixed by utilizing scraps at the time of dissolution.

Containing Co itself does not exert negative effects on the magnetic property, but when it is contained in a large amount, the principal feature of the present invention, that is to provide a low cost product can not be achieved, so that Co is preferably contained below 5 wt %.

The alloy powders for bond magnet according to the present invention having the mean particle sizes of 10 μm to 200 μm is manufactured by well known grinding methods such as a jaw crusher, a ball mill and the like, after two-stage heat treatments of fusing at 900° C. to 1200° C. and aging at 500° C. to 700° C. of an alloy (an ingot) prepared by the high-frequency dissolution at atmospheric temperature of, for example, 1600° C. to 1700° C.

In the alloy powders of the present invention, it is not preferable if the mean particle size is below 10 μm, because that the grinding cost is too high and, at the same time, a coercive force becomes lower, and since the moldability and uniformity as the bond magnet deteriorate when the mean particle sizes exceeds 200 μm, the mean particle sizes is preferably within the range of 10 μm to 200 μm.

As the methods of obtaining the alloy powders, it is not only the method of grinding the ingot obtained by dissolution, but as far as the particle sizes is within the range of 10 μm to 200 μm, the well known grinding and pulverizing methods such as an atomizing method, which injects gas or water for pulverizing after the dissolution, may be selected suitably.

Also, the heat treatments such as fusing and aging treatments need not be performed independently, they may be performed continuously by controlling the cooling after dissolution.

As a method for manufacturing the bond magnet of the present invention, 20 wt % to 98 wt % of alloy powders having the aforementioned compositions and a binder are mixed, and molded into a predetermined shape by the molding methods such as injection molding, compression molding, extrusion molding and the like.

The amount of alloy powders is preferably 20 wt % to 98 wt %, because that magnetic property as the bond magnet is lowered when below 20 wt %, and it is difficult to mold as a bond magnet when above 98 wt %, particularly 20 wt % to 80 wt % is preferable for convergence use in picture tubes.

In order to obtain the bond magnet having a high fire resistance, a predetermined amount of flame retardant may be mixed besides the alloy powders and the binder, and the same methods as stated above may be adopted.

As the flame retardant, those of bromine type such as decarbromo-diphenyloxide, pentabromo-diphenyloxide, ethylene bistetrabromo-phthalmide, dibromo-neopentyl glycol and the like, and of chlorine type such as chlorinated paraffin, chlorinated polyphenyl, perchlor-pentacyclodecane, dichloranplus, chlorinated diphenyl and the like may be used. Also, those prepared adding 5 wt % to 25 wt % of flame retardant assistants such as synergist of antimony trioxide, additives of zinc boric acid, zinc chloride and the like to these flame retardants may also be used.

Since some of the bromine type flame retardants are prone to produce toxic dioxine at the μme of disposition and combustion at a fire, particularly, it is preferable to use the chlorine flame retardants, which is to be added, at least, 5 wt % or more to obtain the fire resistance of UL-94 Vo, but when the amount of additive exceeds 50 wt %, the moldability is deteriorated and also the cost increases, and hence 5 wt % to 50 wt % is the preferable range.

As the bromine type flame retardants, ethylene bistetrabromo-phthalmide excluding pentabromo-diphenyl-oxide, octabromo-diphenyl-oxide and decabromo-diphenyl-oxide which are prone to produce dioxane, is preferable, and the amount of additive is preferably 5 to 20 wt %. Nonhalogen flame retardants containing no halogen elements such as bromine and chlorine, but containing alumina hydrate and magnesia hydrate can be used.

As the binders, thermoplastic resins such as nylon, polypropylene, polyethylene, polyvinyl chloride, polyphenylene sulfide and the like, thermosetting resins such as phenol resin, epoxy resin and the like, or metal binders such as Al, Zn, Sn, Pb and so on can be selected suitably.

In order to mix and knead the binder, flame retardant and alloy powders and a lubricant may be added or pretreatment may be performed.

It is also efficacious, for improving thermal resistance and strength, to replace a part of flame retardant (including the flame retardant assistant) and/or binder with an inorganic filler consisting of silicates such as magnesium silicate, calcium silicate and the like, and the amount of additive of 2% or more of the components other than the alloy powders is effective, but it is not preferable above 45% because that the moldability is worsened.

The alloy powders for bond magnet of the present invention has properties of 5 KG or more Br, 500 Oe or more iHc and 1 MGOe or more (BH) Max, and by mixing the alloy powders, binder, flame retardant and so on at a predetermined mixing ratio, the bond magnet of the present invention shows properties of 200 G or more Br, 150 Oe or more iHc, 0.01 MGOe or more (BH) max and 0.07%/°C. or less temperature coefficient of Br, particularly, the bond magnet containing 20 wt % to 80 wt % alloy powders shows the high characteristics of 150 G to 1300 G Br, 150 Oe, to 500 Oe iHc, 0.01 MGOe to 0.15 MGOe (BH) max and 0.03% /°C. to 0.05% /°C. temperature coefficient of Br, and is most suitable for convergence use in the picture tubes.

EMBODIMENT 1

Magnetic property and grindability of the powders obtained by pulverizing, in a ball mill for 10 hours, an alloy having the compositions shown in Table 1, which was dissolved by using a high-frequency smelting furnace, and fused at 1200° C. for 15 minutes, aged at 550° C. for 24 hours and further crushed to 35 meshes or less with a jaw crusher, are shown in Table 2. The grindability is shown by yields of the powders passing through 100 meshes.

In Table 1 and Table 2, Samples Nos. 1-1 to 1-8 represent the present invention and Sample Nos. 1-9 to 1-13 represent comparative examples.

As it is apparent from Table 2, in the case of alloy powders whose Al content is below 10 wt % such as the comparative example 1-9, or in the case of alloy powders whose Ni content is above 33 wt %, such as the comparative example 1-10. the magnetic characteristics is deteriorated as compared with the alloy powders according to the present invention.

Also, though the magnetic properties of the alloy powders shown in the comparative examples 1-11 to 1-13 surpass those of the present invention, since a large amount of Co which is precious and scarce in resources is contained, the product is difficult to be provided at low cost.

TABLE 1

| | Sample | Alloy Compositions (wt %) | | | | | | | |
|---|---|---|---|---|---|---|---|---|---|
| | Nos. | Al | Ni | Cu | Ti | Nb | Si | Co | Fe |
| Present Invention | 1-1 | 11.0 | 26.0 | 4.0 | 1.5 | — | 0.1 | — | 57.4 |
| | 1-2 | 13.0 | 25.0 | 3.0 | 2.5 | — | 0.05 | — | 56.45 |
| | 1-3 | 12.0 | 29.0 | 4.0 | — | 1.5 | 0.15 | — | 53.35 |
| | 1-4 | 13.0 | 30.0 | 5.0 | 3.0 | 1.5 | 0.1 | — | 47.4 |
| | 1-5 | 13.0 | 26.0 | 7.0 | 0.5 | 1.0 | 0.2 | — | 52.3 |
| | 1-6 | 13.0 | 25.0 | 4.0 | 0.2 | — | 0.3 | — | 57.7 |
| | 1-7 | 12.0 | 25.0 | 4.0 | 0.3 | — | 0.1 | — | 58.6 |
| | 1-8 | 13.0 | 26.0 | 4.0 | — | 0.4 | 0.15 | — | 56.45 |
| Comparative Example | 1-9 | 9.0 | 21.0 | 3.0 | 2.0 | — | 0.1 | — | 64.9 |
| | 1-10 | 15.0 | 35.0 | 4.0 | — | 3.0 | 0.1 | — | 42.9 |
| | 1-11 | 8.0 | 14.0 | 3.0 | 0.1 | — | 0.6 | 24.0 | 50.3 |
| | 1-12 | 7.0 | 14.0 | 3.0 | 5.5 | — | 0.1 | 35.0 | 35.4 |
| | 1-13 | 7.0 | 18.0 | 3.0 | 4.0 | 2.0 | 0.1 | 25.0 | 40.9 |

TABLE 2

| | Sample Nos. | Alloy Compositions (wt %) Br (G) | iHc (Oe) | (BH)max (MGOe) | Grindability |
|---|---|---|---|---|---|
| Present Invention | 1-1 | 6.5 | 605 | 1.6 | 40 |
| | 1-2 | 6.3 | 650 | 1.5 | 50 |
| | 1-3 | 5.6 | 640 | 1.3 | 55 |
| | 1-4 | 5.1 | 750 | 1.1 | 70 |
| | 1-5 | 5.3 | 550 | 1.2 | 60 |
| | 1-6 | 6.3 | 590 | 1.3 | 3 |
| | 1-7 | 6.3 | 600 | 1.4 | 10 |
| | 1-8 | 6.1 | 580 | 1.2 | 5 |

TABLE 2-continued

| | Sample Nos. | Alloy Compositions (wt %) Br (G) | iHc (Oe) | (BH)max (MGOe) | Grindability |
|---|---|---|---|---|---|
| Comparative Example | 1-9 | 6.7 | 450 | 0.9 | — |
| | 1-10 | 4.8 | 490 | 0.6 | — |
| | 1-11 | 13.0 | 600 | 5.5 | — |
| | 1-12 | 9.0 | 1500 | 5.5 | — |
| | 1-13 | 7.0 | 1100 | 2.3 | — |

EMBODIMENT 2

To the alloy powders of the present invention of Samples No. 1-2 of the Embodiment 1, nylon 6 powder was added as a binder, bromine type ethylene bistetrabromo-phthalmide was added as a flame retardant and antimony trioxide was added as a flame retardant assistant by the compositions shown in Sample nos. 2~8 to 2~3 in Table 3, mixing in a V mixer for 30 minutes and then kneaded in a kneader for 10 minutes as heating at 250° C. to obtain pellets.

The pellets were further molded by an injection molding machine at 280° C. to obtain a 10 mm×10 min×5 mm mold for magnet properties measurement, and a 12.7 mm×12.7 min×0.8 mm mold for fire resistance measurement.

Evaluations on the magnetic properties and fire resistance of the bond magnet are shown in Table 4. The fire resistance evaluation was judged by carrying out the vertical firing test according to the JIS K6911 heat resistant test B to pass a V-o class as the fire resistance or not. The magnetic characteristic evaluation was judged by convergence properties after preparing the magnet for convergence use.

Since the Sample No. 2-3* has a relatively little content of the flame retardant and flame retardant assistant as compared with Samples 2-1 and 2-2, though it does not pass the V-o class as the thermal resistance, its magnetic properties is equal, thus by using in uses not requiring a high thermal resistance, effects of the present invention can be realized.

Also in the following embodiments, as to those having a mark * on the sample numbers, the alloy powders, binder, flame retardant, flame retardant assistant, inorganic filler and so on are not necessarily contained at a proper amount, and the magnetic properties and fire resistance are relatively low as compared with the other samples. However, similar to the Sample No. 2-3*, by selecting their use, the effects of the present invention can be realized.

EMBODIMENT 3

A bond magnet was prepared by the same method as the Embodiment 2, except using nylon 6 powder as a binder and dichloranplus which is a chlorine flame retardant as a flame retardant, and using antimony trioxide as a flame retardant assistant A and zinc chloride as a flame retardant assistant B by blending compositions shown in Table 3.

Evaluations on magnetic properties and fire resistance of the bond magnet are shown in Table 4. The fire resistance was evaluated by the same method as the embodiment 2. The magnet properties was evaluated on convergence properties after preparing the magnet for convergence use.

TABLE 3

| | Sample Nos. | Blending Compositions (wt %) Alloy Powders | Resin | Fire Retardant | Fire Retardant Assistant A | B |
|---|---|---|---|---|---|---|
| Embodiment 2 | 2-1 | 50.0 | 23.0 | 22.0 | 5.0 | — |
| | 2-2 | 50.0 | 15.0 | 25.0 | 10.0 | — |
| | 2-3* | 50.0 | 28.0 | 18.0 | 4.0 | — |
| Embodiment 3 | 3-1 | 50.0 | 20.0 | 13.0 | 15.0 | 2.0 |
| | 3-2 | 30.0 | 28.0 | 21.0 | 19.0 | 3.0 |
| | 3-3 | 40.0 | 25.0 | 16.0 | 17.0 | 2.0 |
| | 3-4 | 60.0 | 15.0 | 18.0 | 6.0 | 1.0 |
| | 3-5 | 70.0 | 10.0 | 12.0 | 7.0 | 1.0 |
| | 3-6* | 15.0 | 35.0 | 29.0 | 18.0 | 3.0 |
| | 3-7* | 70.0 | 20.0 | 4.0 | 5.0 | 1.0 |

TABLE 4

| | Sample Nos. | Magnetic Property Br (G) | iHc (Oe) | (BH)max (MGOe) | Evaluation on Magnet Property | Evaluation on flame retardancy |
|---|---|---|---|---|---|---|
| Embodiment 2 | 2-1 | 370 | 250 | 0.03 | good | qualified |
| | 2-2 | 410 | 270 | 0.03 | good | qualified |
| | 2-3* | 420 | 260 | 0.03 | good | not qualified |
| Embodiment 3 | 3-1 | 530 | 300 | 0.04 | good | qualified |
| | 3-2 | 210 | 160 | 0.01 | good | qualified |
| | 3-3 | 340 | 230 | 0.02 | good | qualified |
| | 3-4 | 850 | 360 | 0.08 | good | qualified |
| | 3-5 | 1210 | 430 | 0.14 | good | qualified |
| | 3-6* | 130 | 110 | 0.005 | poor | qualified |
| | 3-7* | 830 | 370 | 0.07 | good | not qualified |

EMBODIMENT 4

A bond magnet was prepared by the same method as the Embodiment 2, except magnesium silicate (a talc) was added as an inorganic filler, by the blending compositions shown In Table 5, to the same binder, fire retardant and fire retardant assistant as the Embodiment 3.

Evaluation on magnetic characteristics, injection moldability and fire resistance of the bond magnet are shown in Table 6.

The injection moldability was evaluated by judging as good or poor of the injection molding of the embodiment. The flameretardancy was evaluated by the same method as the Embodiment 2.

EMBODIMENT 5

A bond magnet was prepared by the same method as the Embodiment 2, by using the same flame retardant and flame retardant assistant as the Embodiment 3, using a block copolymer of propylene powders of 450 μm mean particle sizes as a resin, and using calcium silicate (wollastonite) as an inorganic filler, except the blending compositions shown in Table 5.

Evaluation on magnetic characteristics, injection moldability and fire resistance of the bond magnet are shown in Table 6.

The injection moldability was evaluated by judging as good or poor of the injection molding of the embodiment. The flameretardancy was evaluated by the same method as the Embodiment 2.

TABLE 5

| | Sample Nos. | Blending Compositions (wt %) Alloy Powders | Resin | Flame Retardant | Flame Retardant Assistant A | B | Inorganic Filler |
|---|---|---|---|---|---|---|---|
| Embodiment 4 | 4-1 | 30.0 | 21.0 | 15.0 | 4.0 | 1.0 | 29.0 |
| | 4-2 | 40.0 | 15.0 | 16.0 | 5.0 | 1.0 | 23.0 |
| | 4-3 | 50.0 | 13.0 | 12.0 | 3.0 | 2.0 | 20.0 |
| Embodiment 5 | 4-4* | 30.0 | 5.0 | 12.0 | 3.0 | 1.0 | 49.0 |
| | 4-5* | 30.0 | 15.0 | 4.0 | 2.0 | 2.0 | 47.0 |
| | 4-6* | 30.0 | 10.0 | 55.0 | 4.0 | 1.0 | — |
| | 5-1 | 30.0 | 18.0 | 17.0 | 5.0 | 1.0 | 29.0 |
| | 5-2 | 40.0 | 15.0 | 15.0 | 4.0 | 2.0 | 24.0 |
| | 5-3 | 50.0 | 14.0 | 13.0 | 4.0 | 2.0 | 17.0 |
| | 5-4* | 30.0 | 20.0 | 4.0 | 3.0 | 1.0 | 42.0 |

TABLE 6

| | Sample Nos | Magnetic Property Br (G) | iHc (Oe) | Evaluation of Injection Moldability | Evaluation of flame retardancy |
|---|---|---|---|---|---|
| Embodiment 4 | 4-1 | 220 | 170 | good | qualified |
| | 4-2 | 430 | 250 | good | qualified |
| | 4-3 | 610 | 320 | good | qualified |
| Embodiment 5 | 4-4* | — | — | poor | — |
| | 4-5* | 240 | 180 | good | not qualified |
| | 4-6* | — | — | poor | — |
| | 5-1 | 205 | 160 | good | qualified |
| | 5-2 | 410 | 230 | good | qualified |
| | 5-3 | 580 | 310 | good | qualified |
| | 5-4* | 260 | 190 | good | not qualified |

EMBODIMENT 6

A bond magnet was prepared by adding 3 wt % epoxy resin to the alloy powders of the present invention, Sample No. 1-1 of the Embodiment 1, and curing at 150° C. for one hour after mixing and compression molding. The bond magnet of the present invention has superior properties of 2.8 kG Br, 570 Oe iHc, and 0.5 MGOe (BH) max.

INDUSTRIAL APPLICABILITY

In the present invention, alloy powders for bond magnet having, high magnetic properties can be obtained without containing Co which is restricted in resources, by compositions of Al-Ni-Cu-(Ti, Nb)-Fe containing no Co; and by kneading, molding and curing the alloy powders for bond magnet together with a chlorine flame retardant, flame retardant assistants such as antimony trioxide and zinc boric acid and a binder, the flame reterdancy bond magnet having superior temperature properties and, particularly, most suitable for convergence use in picture tubes for display and high precision television can be provided at low cost, besides the bond magnet of the present invention is free from discharging toxic dioxane and has a high industrial value.

We claim:

1. An alloy powder for use in forming a bonded magnet, said alloy powder containing no cobalt and consisting essentially of 10 to 16 wt % Al, 23 to 33 wt % Ni, 2 to 8 wt %

Cu, 0.5 to 5 wt % of at least one of Ti and Nb, and a balance of Fe, said powder being in the form of isotropic particles having mean particle sizes of 10 to 200 μm.

2. An alloy powder according to claim 1, including 0.01 to 0.5 wt % Si.

3. An alloy powder according to claim 1, having a coercive force (Hc) of at least 500 Oe.

4. A bonded magnet comprising a mixture of a binder and alloy powder containing no cobalt and consisting essentially of 10 to 16 wt % Al, 23 to 33 wt % Ni, 2 to 8 wt % Cu, 0.5 to 5 wt % of at least one of Ti and Nb, and a balance of Fe, said powder being in the form of isotropic particles having mean particle sizes of 10 to 200 μm.

5. A bonded magnet according to claim 4, wherein said alloy powder includes 0.01 to 0.5 wt % Si.

6. A bonded magnet according to claim 4, wherein said mixture includes 20 to 98 wt % of said alloy powder.

7. A bonded magnet according to claim 6, wherein said mixture includes 20 to 80 wt % of said alloy powder.

8. A bonded magnet according to claim 6, including 5 to 50 wt % of a flame retardant material.

9. A bonded magnet according to claim 8, wherein said flame retardant material contains a halogen selected from the group consisting of chlorine and bromine.

10. A bonded magnet according to claim 8, including a flame retardant assistant material selected from the group consisting of antimony trioxide, zinc boric acid and zinc chloride.

11. A bonded magnet according to claim 8, including 2 to 45 wt % of an inorganic filler other than said alloy powder.

12. A bonded magnet according to claim 11, wherein said inorganic filler consists of a silicate.

13. A bonded magnet according to claim 4, displaying magnetic properties of Br of 200 to 1300 G, a $(BH)_{max}$ of 0.01 to 0.15 MGOe, and a temperature coefficient the magnet properties of 0.03 to 0.07%/°C.

* * * * *